US005289864A

United States Patent [19]

Bouchier

[11] Patent Number: 5,289,864

[45] Date of Patent: Mar. 1, 1994

[54] SHUTTER DRIVE

[75] Inventor: Raymond Bouchier, Wibsey, United Kingdom

[73] Assignee: Bolton Brady Ltd., Bolton, United Kingdom

[21] Appl. No.: 11,379

[22] Filed: Jan. 29, 1993

[30] Foreign Application Priority Data

Jan. 30, 1992 [GB] United Kingdom ..... 9202001

[51] Int. Cl.[5] ..... E05F 15/00

[52] U.S. Cl. ..... 160/188; 160/310; 74/89.21

[58] Field of Search ..... 160/188, 189, 310, 311, 160/312, 331, 133, 1, 7, 23.1, 26, 33; 74/89.21; 474/101, 102, 106

[56] References Cited

U.S. PATENT DOCUMENTS

| | | | |
|---|---|---|---|
| 2,747,661 | 5/1956 | Lucas | 160/310 X |
| 2,934,139 | 4/1960 | Wardlaw et al. | 160/310 X |
| 2,978,019 | 4/1961 | Carlo | 160/23.1 |
| 3,451,463 | 6/1969 | Lyman | 160/310 X |
| 3,465,805 | 9/1969 | Lyman | 160/133 X |
| 3,490,514 | 1/1970 | Duncan et al. | 160/310 X |
| 3,642,049 | 2/1972 | Lyman | 160/23.1 |
| 3,680,622 | 8/1972 | Lester | 160/133 X |
| 3,807,480 | 4/1974 | Smart | 160/1 |
| 4,754,795 | 7/1988 | Garrod | 160/133 |

*Primary Examiner*—David M. Purol

*Attorney, Agent, or Firm*—Ware, Fressola, Van Der Sluys & Adolphson

[57] ABSTRACT

An auxiliary drive unit (30) intended for driving a chain (11) in a horizontal track (12) is arranged to operate only when a forward end (33) of the chain passes a predetermined point. A drive sprocket (16) engages with the chain and initially freewheels until the forward end (33) of the chain contacts a switch (34), actuating a drive motor (13) of the auxiliary drive (30). The drive sprocket (16) is normally "parked" in a precisely orientated position so as to engage the forward end (33) of the chain (11) cleanly. The sprocket (16) has a plurality of circumferentially spaced alternating polarity magnetic poles (22, 23) which park the sprocket (16) precisely in position relative to opposite polarity magnetic poles (27) provided on a fixed member of the auxiliary drive unit. The auxiliary drive unit (30) is particularly designed for driving a rolling shutter (10) suspended from a chain (11) running in a horizontally extending track (12).

5 Claims, 2 Drawing Sheets

SHUTTER DRIVE

BACKGROUND FIELD OF THE INVENTION AND RELATED ART

Figure 1:
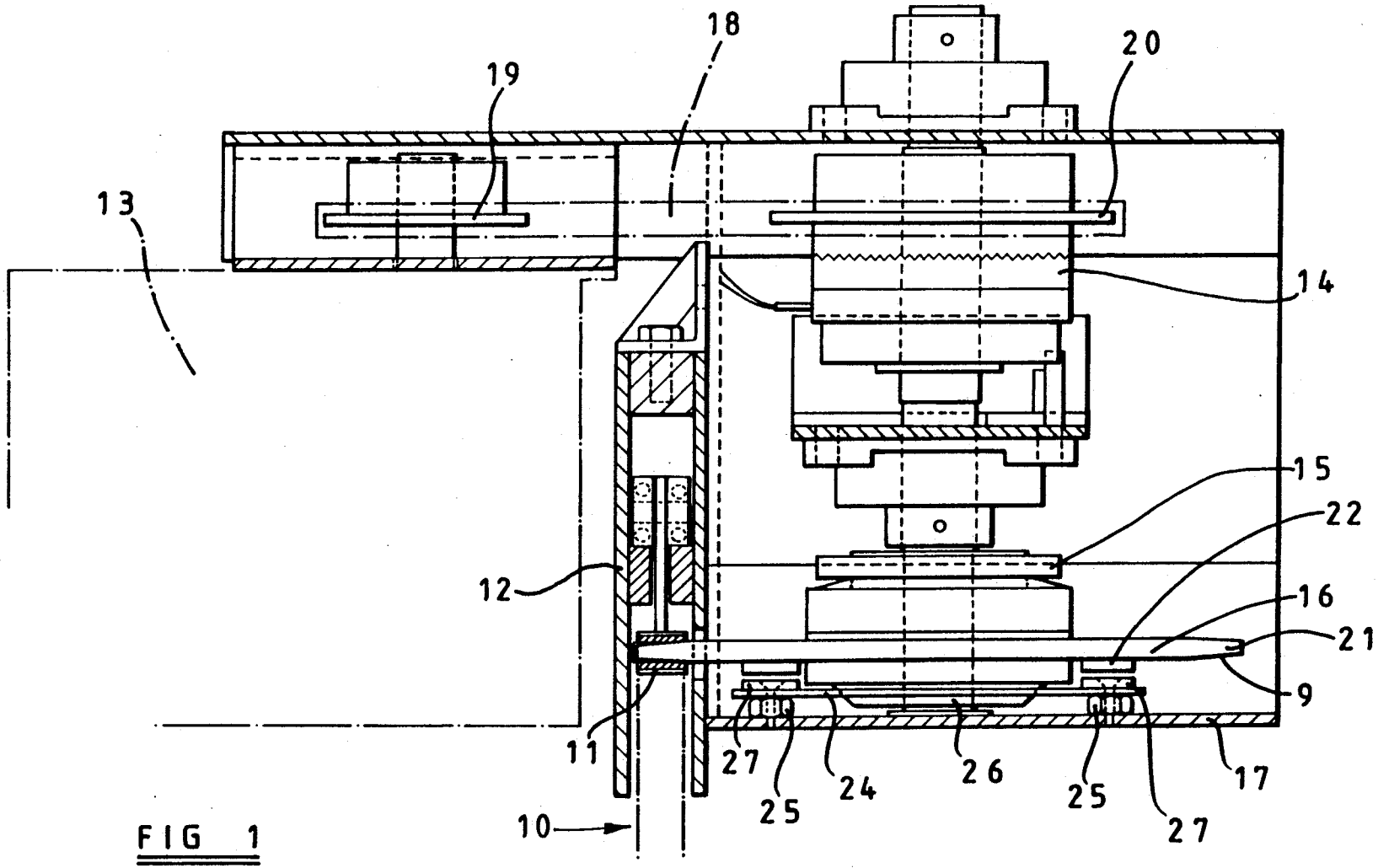

This invention relates to a drive for a rolling shutter of the type which is suspended beneath a generally horizontally extending track and which travels on a linear or non-linear path extending horizontally. Such a shutter may be for example of the type set out in our prior British patent number 2I84474.

In that patent, there is described and claimed a horizontally moving shutter which, when fully stowed away, is rolled about a vertical barrel. It is driven by a motor acting on a drive sprocket at the barrel and is pushed out from the barrel housing along the track. The shutter curtain is tensioned throughout its movement by a substantially constant tension spring arrangement which also assists in returning the shutter to the barrel when it is being stowed.

It has been found possible by this means to drive extremely large shutters, up to 30 meters in length.

However, there is a problem with driving a shutter of this type over a longer distance or with driving a shutter of substantial length around a very circuitous track which has a tendency to increase the friction met by the shutter. Clearly, it is undesirable to overstrain the drive motor. However, increasing the horsepower of the drive motor is not the answer to the problem of extending the shutter further.

It has been proposed to attach a motor to the far end of the track and, by means of cables to pull the shutter into its extended fully opened condition but this is most unsatisfactory because the cable needs to be guided around the track if there are any bends in the track and also tends to sag along its length, stretch in use and otherwise cause problems.

It would be desirable to provide an auxiliary drive such that, at a predetermined distance from the barrel housing, the leading end of the shutter is engaged by the auxiliary drive and is driven forwards in addition to the continuing operation of the main drive motor. Although this would be desirable, hitherto no means has been found of engaging an auxiliary drive motor with the leading end of the shutter in motion.

It will be appreciated that a metal rolling shutter of perhaps 30–40 meters in length has a very substantial mass and, even when moving at a relatively slow speed, has very substantial momentum. In an attempt to engage a drive with such a moving shutter, it is essential to ensure that the auxiliary drive engages the shutter cleanly at the appropriate position without obstructing its passage. Otherwise there is a danger of either jamming the shutter or damaging the auxiliary drive or both. It is also essential to synchronise the auxiliary and main drives.

SUMMARY OF THE INVENTION

It is an object of the present invention to provide an auxiliary drive which overcomes or reduces the disadvantages set out above.

However, although the invention was specifically devised for use in driving a long horizontally extending rolling shutter, it could be applied to driving other forms of rolling shutter, for example escalator shutters or conventional vertical rolling shutters or could be applied to driving other forms of chain drive such as those used in conveyors. It is therefore a broad object of the invention to provide an auxiliary drive means for a drive chain guided in a track.

According to the invention there is provided auxiliary drive means for driving a chain in a track, the auxiliary drive means comprising a drive sprocket adapted to engage the chain;

motor means adapted to rotate the drive sprocket;

actuator means for actuating the motor means and torque limiter means between the motor and the drive sprocket;

characterised in that the drive sprocket is provided with a plurality of circumferentially spaced magnetic poles and the auxiliary drive includes a fixed member provided with a plurality of similarly spaced magnetic poles, opposed in polarity to those of the drive sprocket when the drive sprocket is in the correct position to engage a leading edge of the chain.

Preferably an even number of magnetic poles is provided, alternating in polarity.

Electromagnetic clutch means may be provided to engage the motor means with the drive sprocket. The clutch means may be operated by the actuator means which may comprise an electric switch adapted to operate when contacted by the leading edge of the chain.

The auxiliary drive means may be provided for driving a chain supporting a rolling shutter of the type driven in a horizontal direction and guided by a track.

THE DRAWINGS

Figure 2:
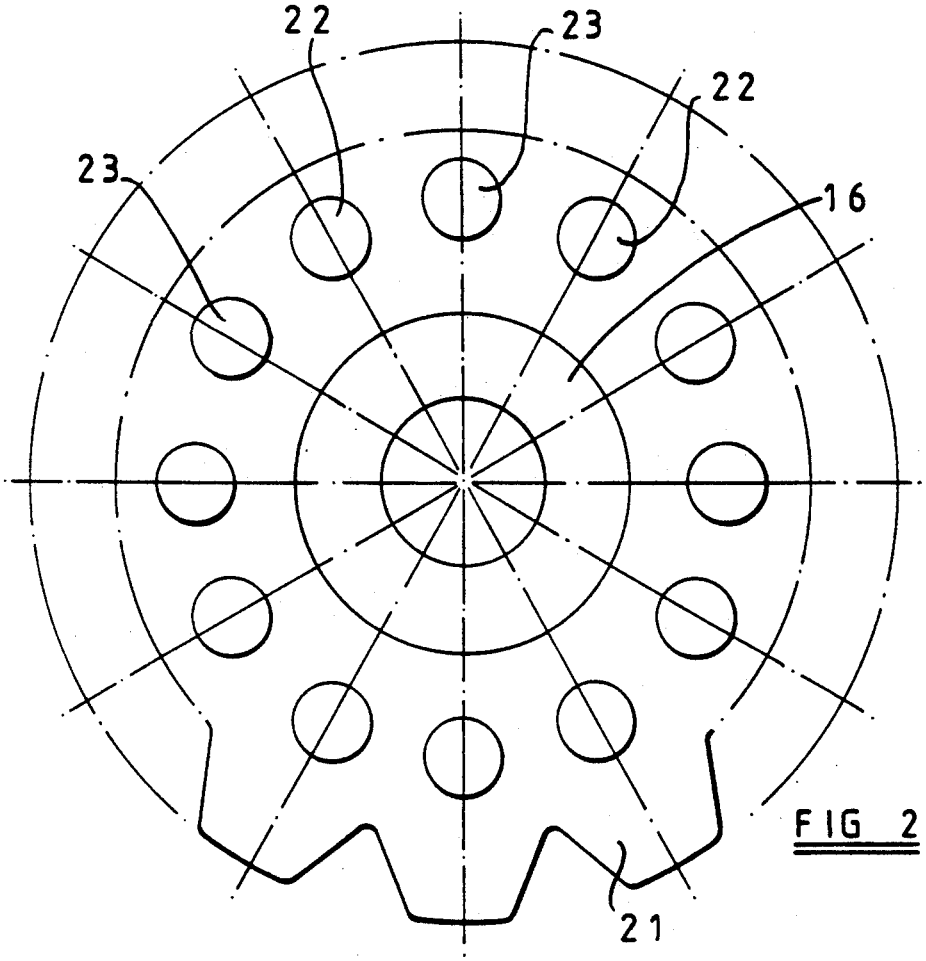
Figure 3:
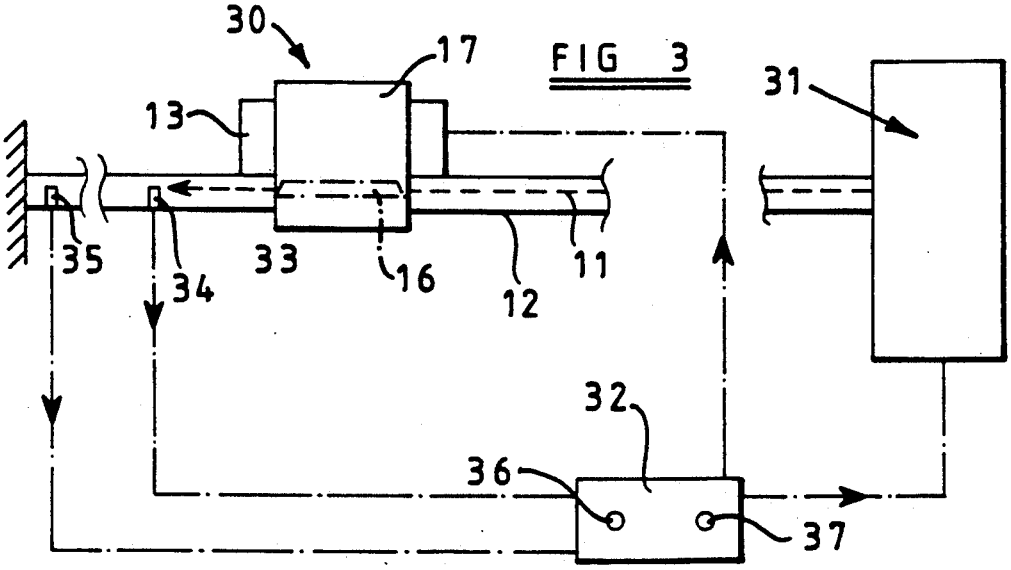

An auxiliary drive embodying the invention will now be described by way of example only with reference to the accompanying drawings in which FIG. 1 is a vertical sectional view to an auxiliary drive for a horizontally driven rolling shutter, FIG. 2 is a detail elevational view, on an enlarged scale, of a drive sprocket as the drive of FIG. 1, FIG. 3 is a diagrammatic illustration of a shutter having a main and an auxiliary drive.

BEST MODE FOR CARRYING OUT THE INVENTION

Referring to the drawings, a rolling shutter which may be of the type described in our British Patent 2184474 is generally indicated at 10. It comprises a plurality of laths hanging from a drive chain 11 which is guided within a fixed, horizontally extending track 12.

The auxiliary drive 30 comprises a motor which is shown in chain dotted outline at 13, an electromagnetic clutch 14, a torque limiter 15 and a drive sprocket 16, all mounted within a housing 17. Drive from the motor 13 is transmitted via a belt drive 18, driving and driven sprockets 19 and 20. The motor 13 is mounted at the opposite side of the track 12 from the remainder of the auxiliary drive means so as to obtain a balanced weight distribution on the track 12, although this is optional.

As will be seen from FIG. 1 of the drawings, the drive sprocket 16 of the auxiliary drive means has slightly tapering faces 9 on the drive teeth 21 so as to engage cleanly within the drive openings of the chain 11. However, it is essential that the teeth 21 of the drive sprocket 16 are correctly in register with the leading end of the chain 11 as the chain comes up to the position of the auxiliary drive means 30 along the track. If the drive sprocket is not correctly aligned, the drive chain 11 may strike the teeth of the sprocket at such an angle as to either jam the shutter or damage the sprocket and the associated parts of the auxiliary drive means.

It is therefore essential that the drive sprocket should reliably retain the correct position relative to the track when it is not engaged with the chain 11 of the shutter 10.

To this end, the drive sprocket which is shown in more detail in FIG. 2, is provided with a plurality of circumferentially spaced permanent magnets 22, 23. The magnets 22 are of a first polarity and the magnets 23 are of the opposite polarity so that the magnetic poles alternate around the sprocket. It will be seen that these magnetic poles are provided on disc shaped magnets which are well spaced inboard of the teeth 21 of the sprocket. Thus the magnets themselves do not take any part in engaging the drive chain 11.

A fixed disc 24 is bolted at 25 within the housing 17. The fixed plate 24 surrounds the bearing 26 of the drive sprocket. The plate 24 is provided with further permanent magnets 27. Again, the magnets 27 are arranged in a circle spaced at the same pitch as the magnetic poles 22 and 23 on the sprocket 16. The magnets 27 alternate in polarity around the plate 24.

If will therefore be understood that, when the sprocket 16 is not being driven but is freely rotatable, the magnetic force between the poles 22 and 23 on the sprocket and the alternating poles 27 on the plate causes the sprocket to settle into the lowest energy position where the magnetic poles on sprocket and plate oppose and therefore attract each other. If the sprocket is in any other position, the repulsive forces between like magnetic poles tend to cause it to turn towards the nearest position in which the opposite poles are aligned.

The arrangement of the poles around the sprocket and the plates 16 and 24 is such that, when the poles are correctly aligned, the sprocket teeth 21 are in precisely the correct position in relation to the track 12 to allow for clean engagement of the teeth 21 of the sprocket by the leading edge of the chain 11 as it comes along the track 12.

As shown in FIG. 3, a rolling shutter having a horizontal direction of movement is driven by a main drive motor 31 and the auxiliary drive 30. The arrangement is that the main drive motor 31 is disposed within a shutter barrel housing and is controlled by control means 32 having a forward button 37, operation of which pushes the shutter outwardly with its chain 11 running along the track 12 and supporting the main shutter curtain 10. When the forward end 33 of the chain 11 meets the sprocket 16 of the auxiliary drive, the teeth 21 engage cleanly within the chain 11 and, initially, the sprocket 16 is rotated by the movement of the rolling shutter 10.

It will be appreciated that, because the alignment of the sprocket 16 is achieved without mechanical means, but purely magnetically, there is very little resistance to rotation of the sprocket 16 as the chain picks it up.

When the chain 11 proceeds a little further along the track, the forward end 33 reaches a switch 34 which provides a signal to the control means 32 to actuate the electric motor 13 and the drive to the sprocket 16. Up to this point, the sprocket 16 is free wheeling.

When the switch 34 operates, the motor 13 starts to drive and the electromagnetic clutch 14 transmits this drive to the sprocket 16, which then ceases to free wheel and starts to power assist the auxiliary drive to the chain and the remainder of the shutter.

It will be appreciated that the speed of the sprocket 16 when driven needs to be matched to the speed of the main drive 31 in the shutter barrel housing. This synchronous running of the motors is achieved so far as possible by correct selection of the speed of the motor 13 and selection of the drive components 18, 19, 20. However to compensate for any small deviation, the torque limiter 15 allows slip in the system if the motor 13 is driving a sprocket 16 fractionally too fast or too slowly.

When the forward end 33 of the chain has been driven out to its fullest extent and the shutter is completely closed, a further limit switch 35 is operated by the forward end of the chain. This signals the control means 32 to cut the drive to both the main drive motor 31 and the auxiliary drive motor 13.

When the shutter is to be returned to the housing, the operator presses the return button 36 on the control means 32 and this re-start starts the main drive motor 31 in reverse. When the shutter is constructed according to our British Patent No. 2184474, the shutter curtain is continuously tensioned by a substantially constant tension spring arrangement in the barrel and hence tends to want to return towards the barrel. This constant tension assists the main drive motor 31 so it is not considered necessary to operate the auxiliary drive means to return the shutter to its housing. However, in some circumstances it might be considered desirable for the auxiliary drive to operate in addition to the main drive.

The electromagnetic clutch 14 is disengaged so that only the main drive operates and the auxiliary drive is cut out. The sprocket 16 is then allowed to free wheel as the chain 11 moves back along the track 12 until the end of the chain passes the position of the auxiliary drive means 30. The sprocket teeth 21 are then released from the chain and the sprocket immediately rotates into the predetermined position in which the opposed pairs of magnets face each other. Thus, on the next occasion when the shutter is driven out by the main drive motor, it will pick up cleanly the teeth 21 on the sprocket 16 and allow the auxiliary drive means to be engaged.

Although the auxiliary drive means described has been devised for assisting in driving very long lateral rolling shutters, it might be envisaged for use in shorter rolling shutters where some particular constraint makes conventional drive difficult. For example, if the shutter is exceptionally heavy, the extra power to drive it may advantageously be provided by the auxiliary drive means rather than increasing the rating of the main drive motor. If the shutter is stopped part way along the track and then restarted, the inertia of a heavy shutter may overload the main drive motor and for this reason it may be preferable to place an auxiliary drive motor part way along the track, operating as described. Another circumstance in which an auxiliary drive means may be desirable is where a shutter is driven round a very circuitous route, adding to the resistance to movement of the shutter.

In addition to assisting in driving the shutter, the auxiliary drive means may assist in keeping the shutter curtain tensioned by keeping the chain taut in the track 12.

I claim:

1. Auxiliary drive means for driving a chain in a track, said chain having a leading edge, the auxiliary drive means comprising a drive sprocket adapted to engage the chain;

motor means adapted to rotate the drive sprocket;

actuator means for actuating the motor means;

torque limiter means operatively connected between the motor and the drive sprocket;

a fixed member provided with a plurality of circumferentially spaced magnetic poles;

a corresponding plurality of similarly spaced magnetic poles being provided on the drive sprocket;

the magnetic poles on the fixed member and on the drive sprocket being opposed in polarity when the drive sprocket is in a correct position to engage the leading edge of the chain.

2. Auxiliary drive means according to claim 1 wherein each of said pluralities of circumferentially spaced magnetic poles is an even number, said magnetic poles alternating in polarity about the circumference.

3. Auxiliary drive means according to claim 1 and comprising electromagnetic clutch means operatively connected between the motor means and the drive sprocket.

4. Auxiliary drive means according to claim 3 wherein said actuator means comprises an electric switch adapted to operate when contacted by the leading edge of the chain and wherein the clutch means are operated by the actuator means.

5. In combination, auxiliary drive means according to claim 1 and a rolling shutter including a chain guided by a horizontal track, said rolling shutter being driven in a horizontal direction.

* * * * *